United States Patent [19]

Brunkan

[11] Patent Number: 4,729,149

[45] Date of Patent: Mar. 8, 1988

[54] GATE HINGE ASSEMBLY

[75] Inventor: B. J. Brunkan, Memphis, Tenn.

[73] Assignee: Hackney Wholesale, Memphis, Tenn.

[21] Appl. No.: 918,844

[22] Filed: Oct. 14, 1986

[51] Int. Cl.[4] ..... E05D 5/02

[52] U.S. Cl. ..... 16/252; 16/253

[58] Field of Search ..... 16/252, 253, 382, DIG. 40; 269/256, 43; 403/3, 4, DIG. 9, 385, 400

[56] References Cited

U.S. PATENT DOCUMENTS

| | | | |
|---|---|---|---|
| 113,998 | 4/1871 | Garrett | 16/253 |
| 664,638 | 12/1900 | Hitchcock | 403/385 |
| 1,180,069 | 4/1916 | Osgood | 16/253 |
| 2,651,806 | 9/1953 | Thompson | 16/253 |
| 2,763,890 | 9/1953 | Cox | 16/253 |

*Primary Examiner*—Nicholas P. Godici
*Assistant Examiner*—Edward Brown
*Attorney, Agent, or Firm*—Walker & McKenzie

[57] ABSTRACT

A gate hinge assembly including first and second complementary clamp members for fitting on opposite sides of a circular gatepost. Each clamp member has a substantially V-shaped vertical groove in the inner side thereof for engaging opposite sides of the post. Bolts are used to attach the opposite ends of each clamp member to one another about the post. Structure is attached to one of the clamp members to pivotally couple a gate thereto for thereby swingably coupling the gate to the post.

10 Claims, 10 Drawing Figures

FIG. 2
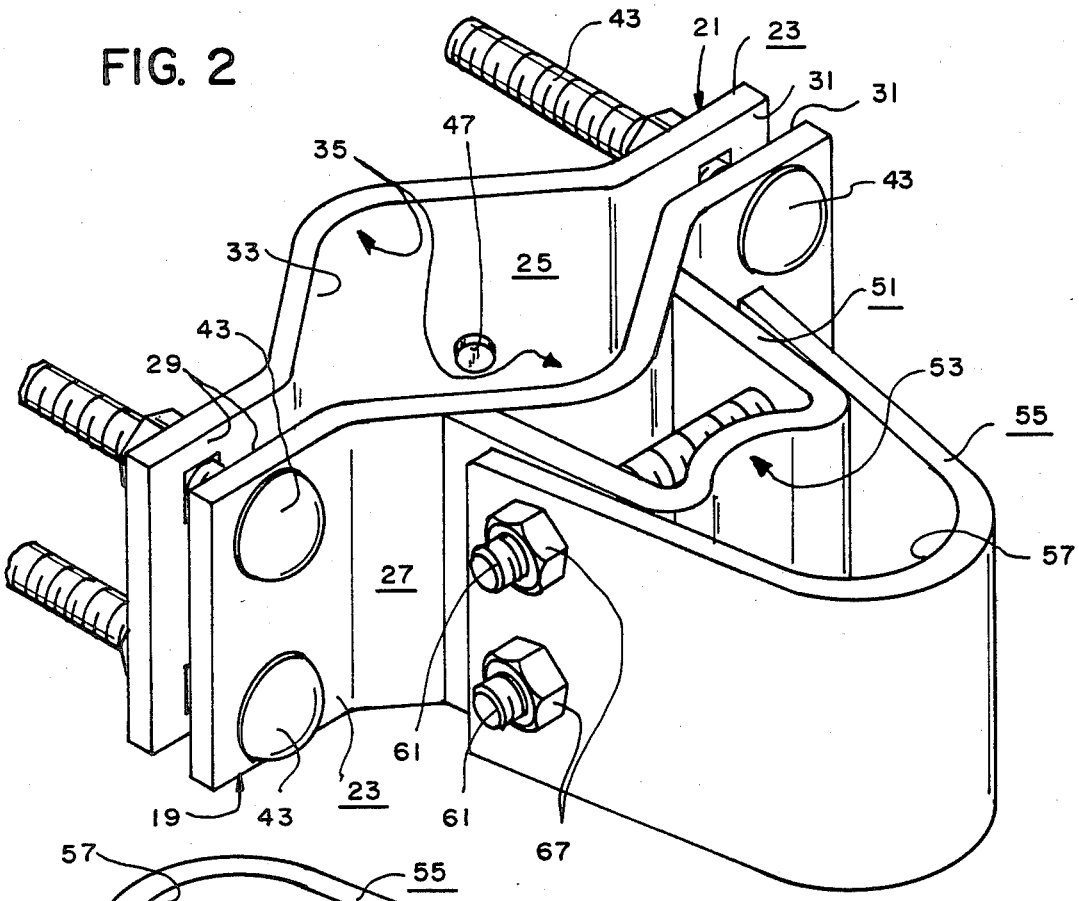
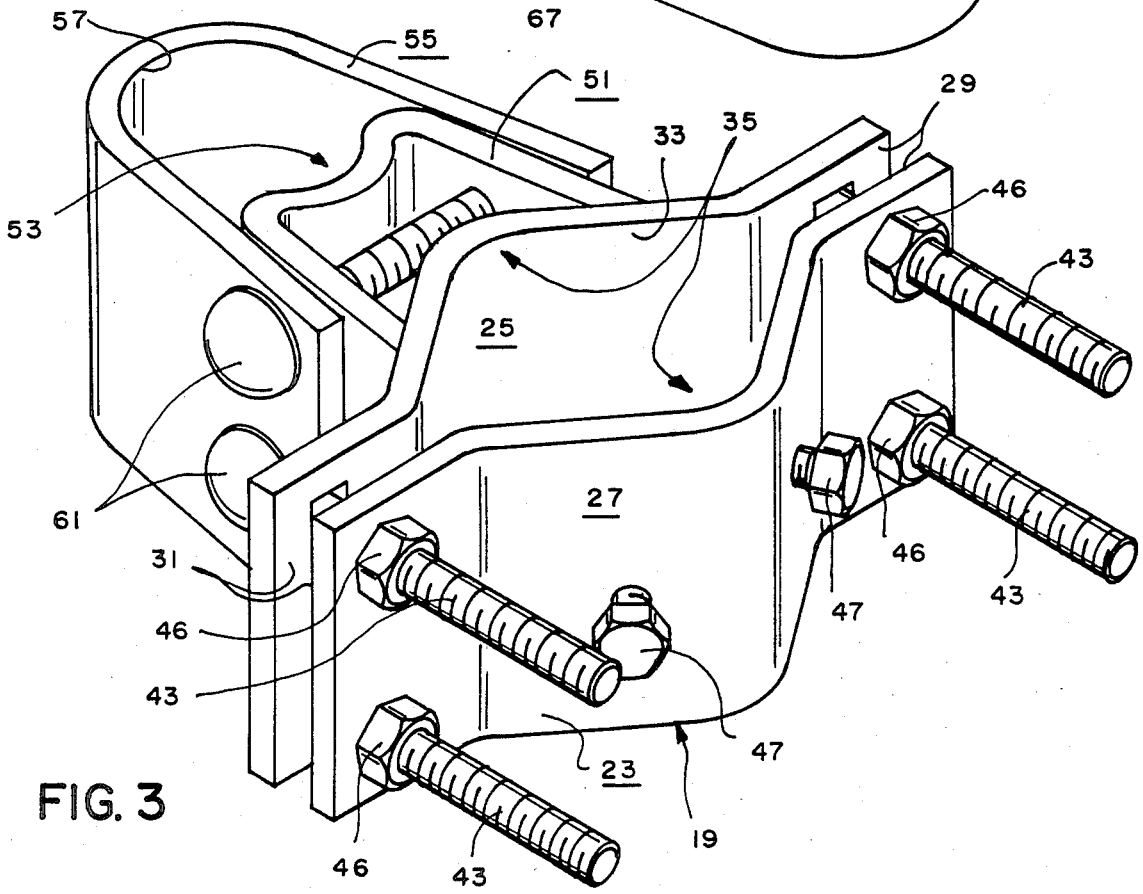
FIG. 3

GATE HINGE ASSEMBLY

BACKGROUND OF THE INVENTION

1. The Field of the Invention: The present invention relates in general to hinge assemblies for attaching gates to terminal gate posts.

2. Description of the Related Art: Various gate post hinge assemblies have heretofore been developed. A preliminary patentability search in class 16, subclasses 86.1, 252 and 253 disclosed the following U.S. Pat. Nos.: 113,998 to Garrett; 1,180,069 to Osgood; 1,634,337 to Panoch; 2,651,806 to Thompson; 2,763,890 to Cox, 3,727,266 to Ashworth; and 3,811,149 to Griffin. The U.S. Pat. No. 2,763,890 to Cox discloses a gate hinge comprising a clamp consisting of a pair of elongated straps curved in a semicircle intermediate their ends to conform to a side of a cylindrical gate post of a specific diameter, bolts for clamping the straps to one another about the post, and a U-shaped bracket attached to the clamp for embracing an upright member of a gate. None of the known prior art discloses or suggests the present invention.

SUMMARY OF THE INVENTION

The present invention is directed toward providing a highly adjustable commercial-type hinge assembly for attaching a gate to a cylindrical terminal gate post. The gate hinge of the present invention comprises, in general, (a) first and second clamp members, each clamp member having an inner side with first and second ends and a midportion joining the first and second ends; the midportion of the inner side of each clamp member having a substantially V-shaped vertical groove therein for allowing each clamp member to be centered about a cylindrical gate post of any standard cross-sectional dimension; (b) attachment means for securely attaching the clamp members to one another and to the gatepost; and (c) coupling means for allowing the clamp members to be swingably coupled to a circular upright member of a gate of any standard cross-sectional dimension.

BRIEF DESCRIPTION OF THE DRAWINGS

FIG. 2 is a perspective view of the gate hinge assembly of the present invention.

FIG. 3 is a perspective view of the gate hinge assembly of the present invention from the side opposite FIG. 2.

DESCRIPTION OF THE PREFERRED EMBODIMENT

Figure 4:
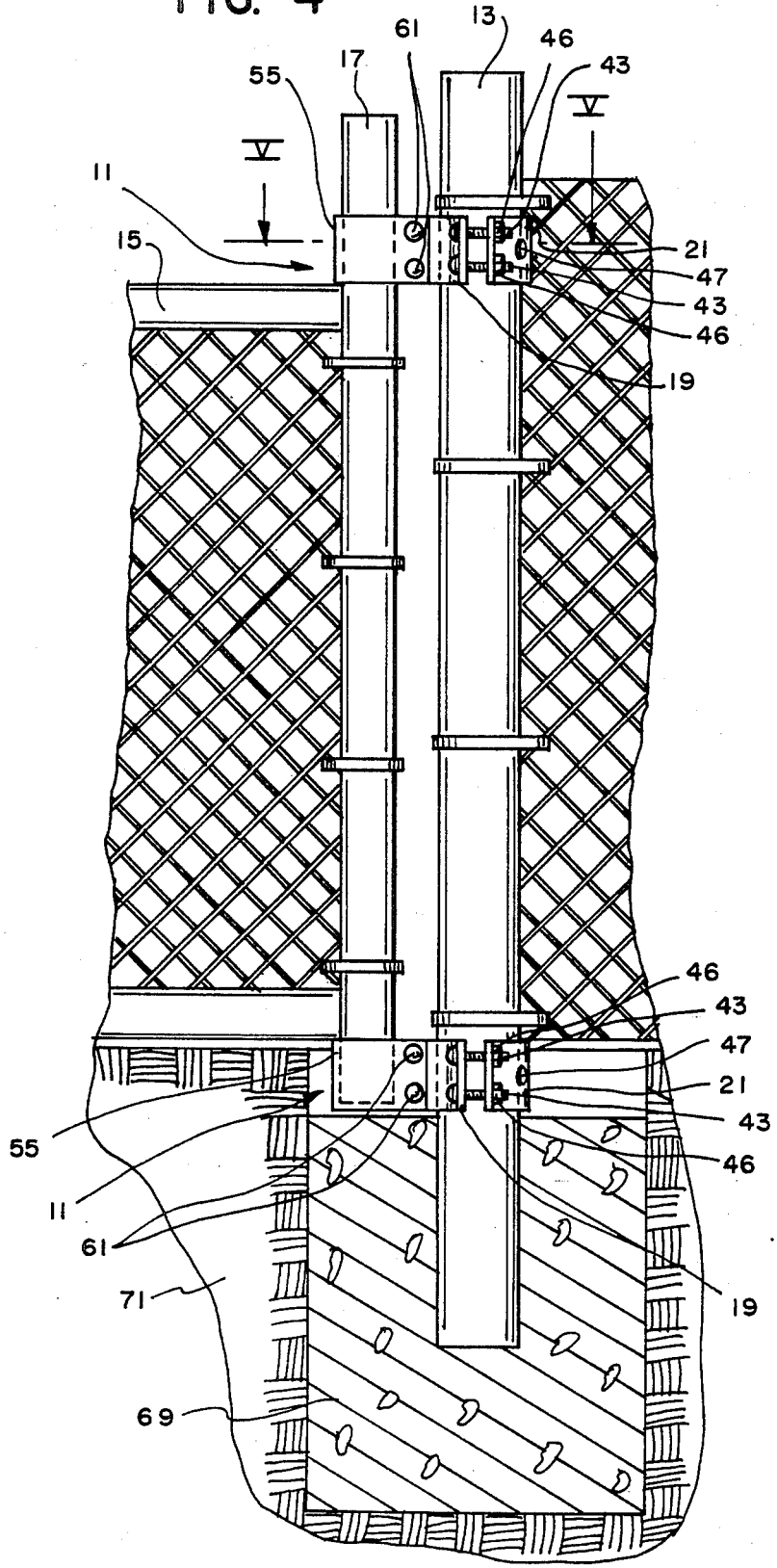
FIG. 4 is a front elevational view of a gate shown attached to a terminal gatepost by a pair of the gate hinge asemblies of the present invention.
Figure 5:
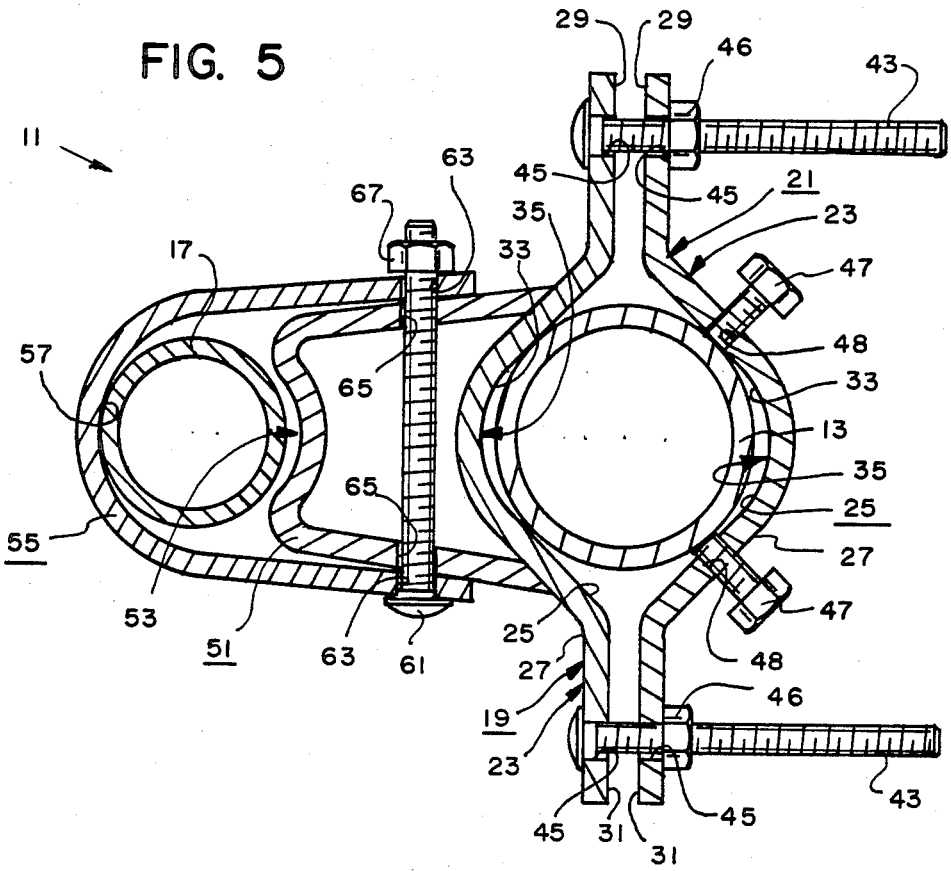
FIG. 5 is an enlarged sectional view substantially as taken on line V—V of FIG. 4.
Figure 6:
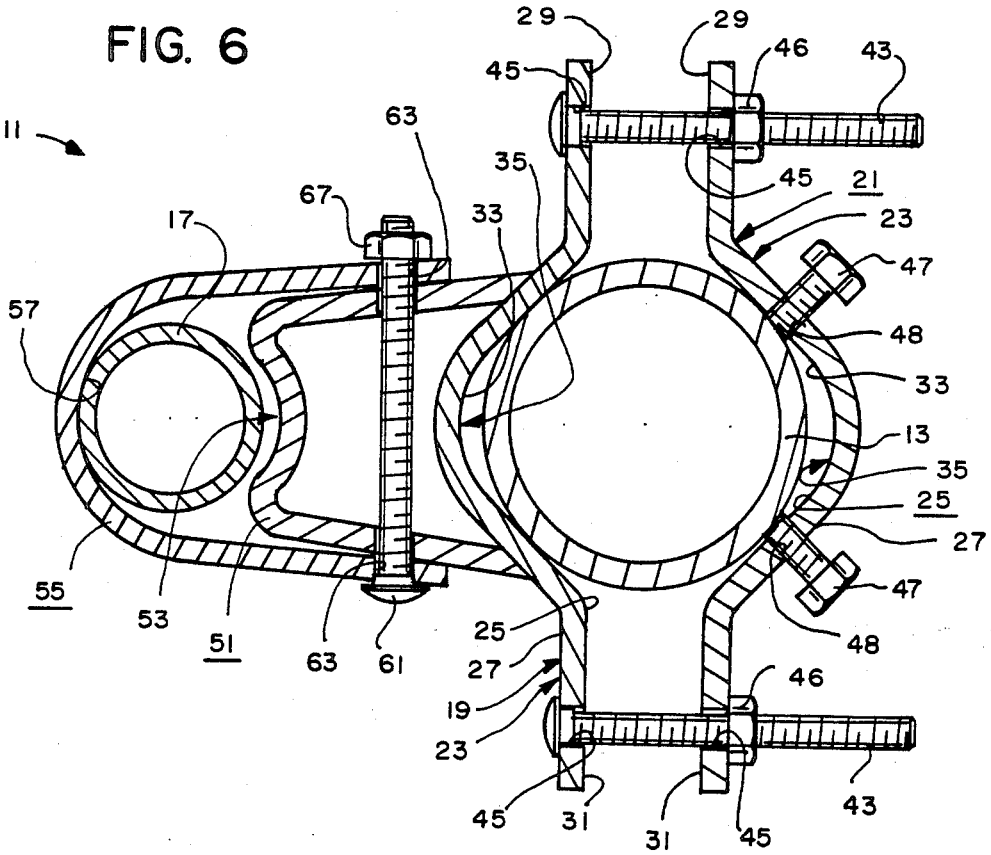
FIGS. 6–9 are sectional views similar to FIG. 5, but showing the gate hinge assembly of the present invention associated with gate posts of different diameters.
Figure 7:
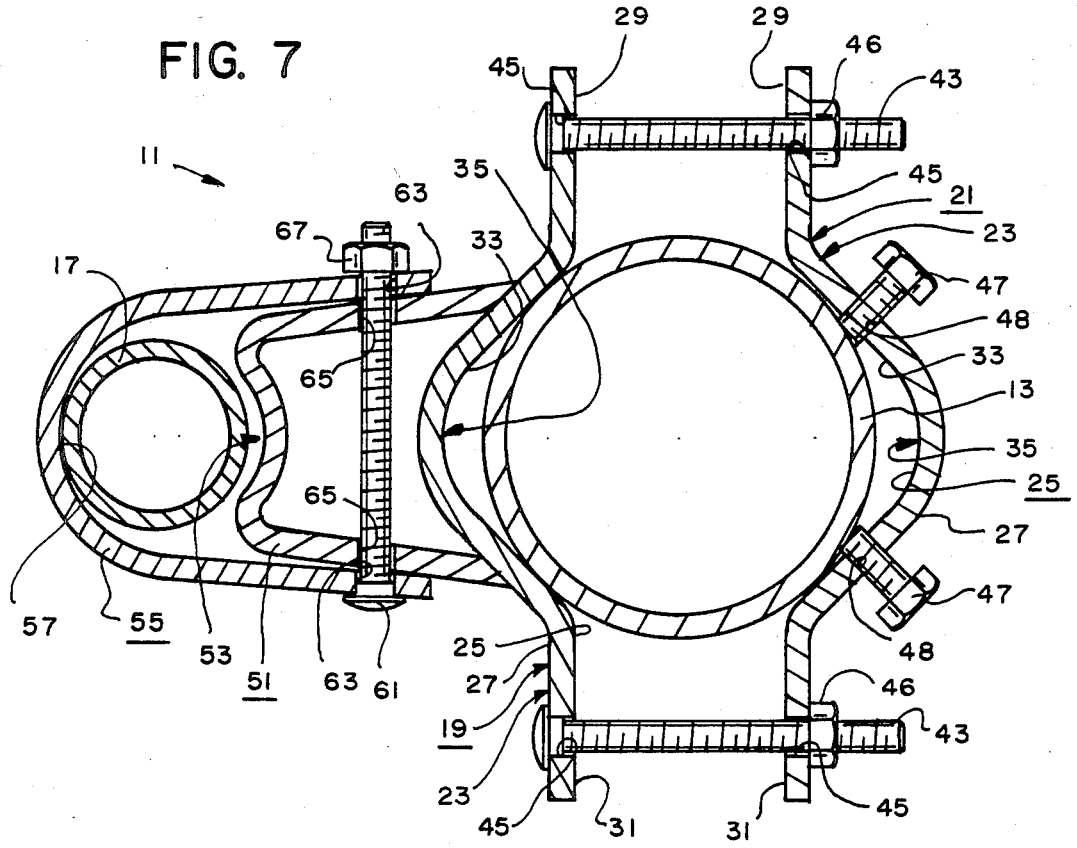
Figure 8:
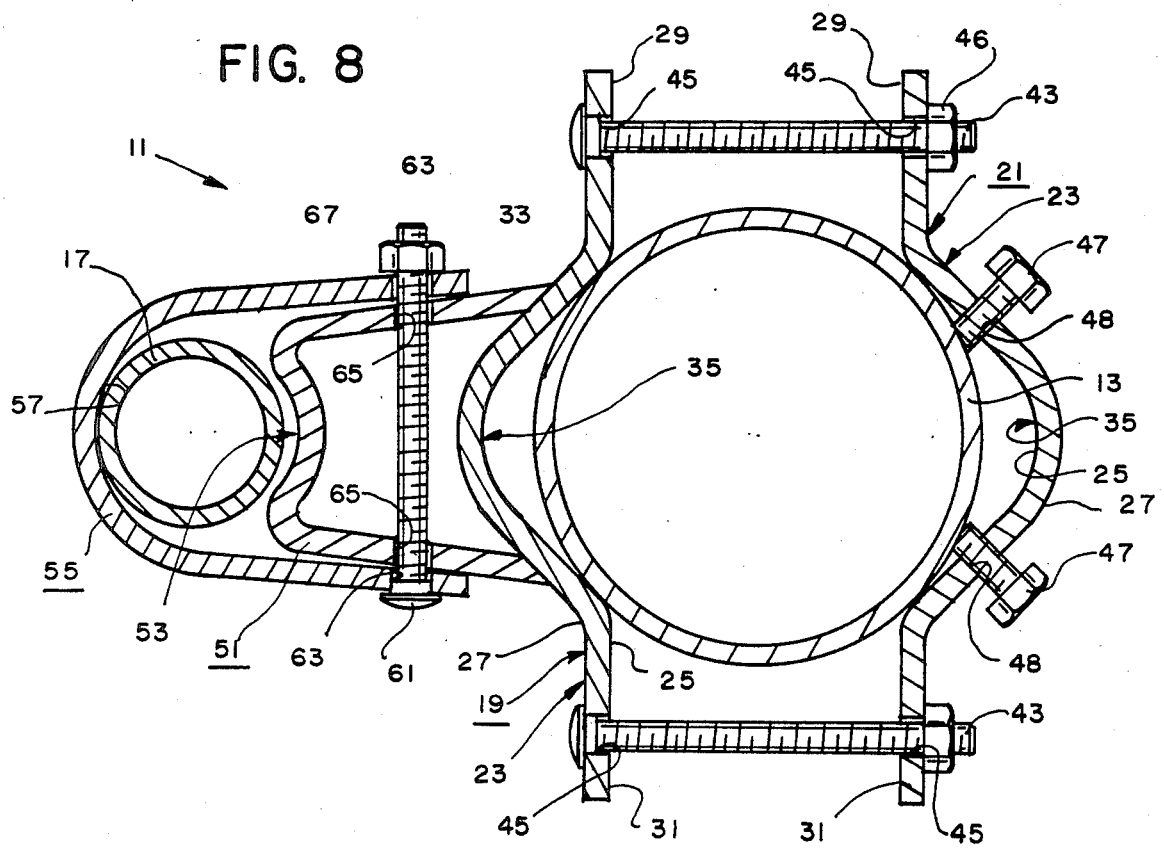
Figure 9:
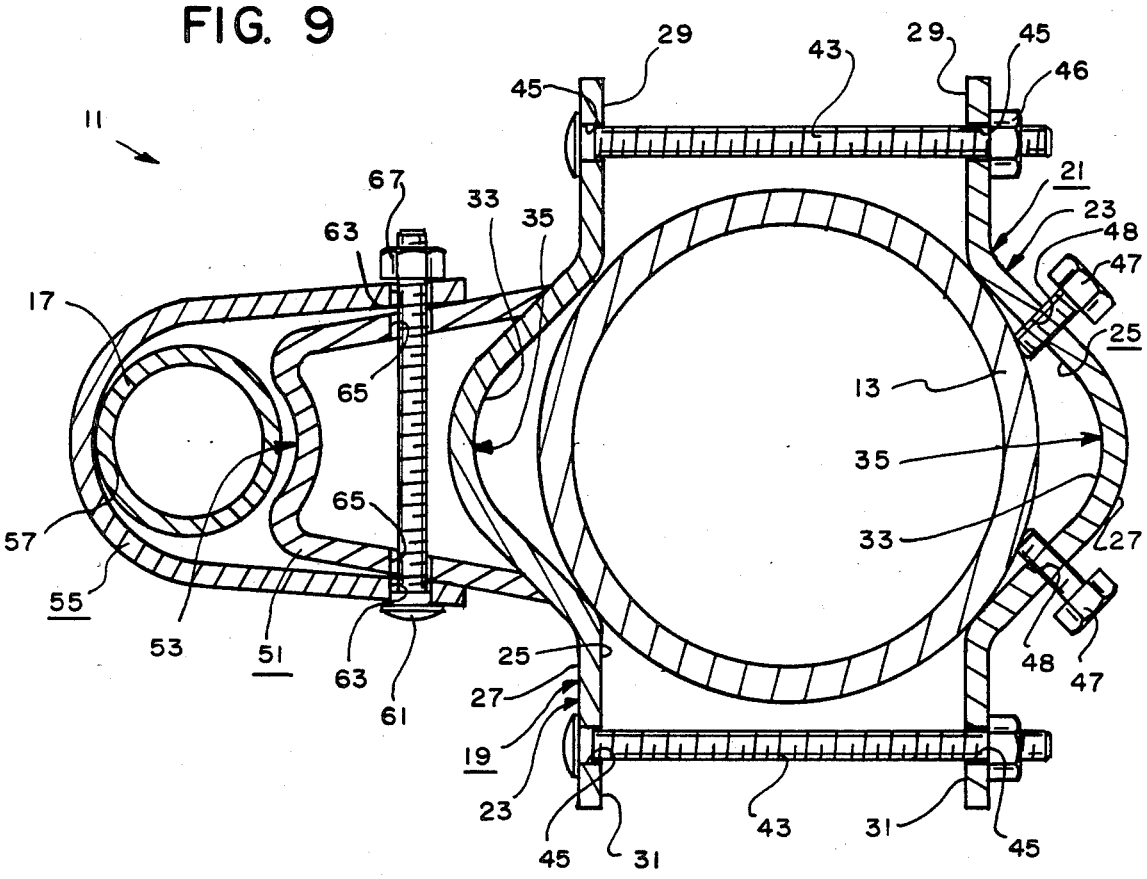
Figure 10:
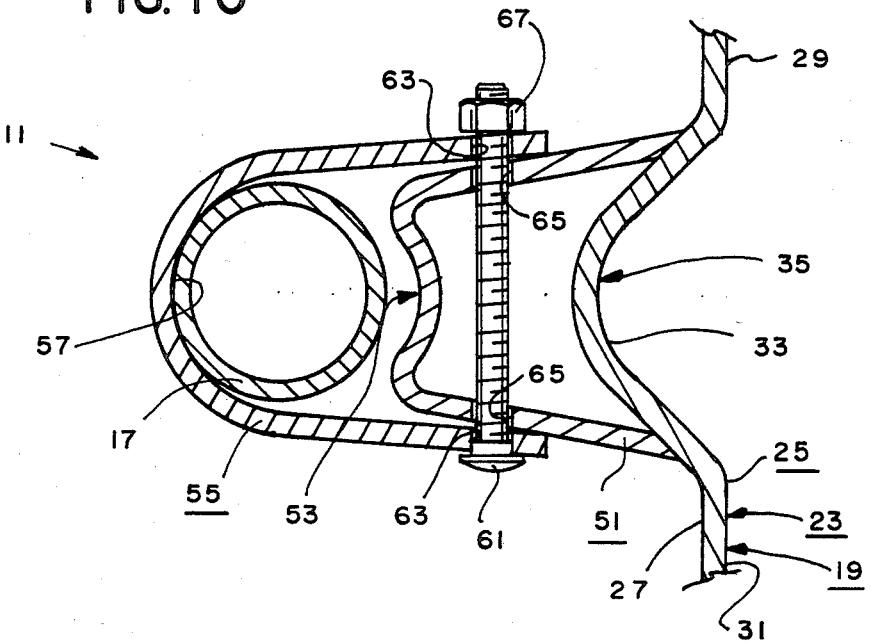
FIG. 10 is a sectional view similar to a portion of FIGS. 5–9, but showing the gate hinge assembly of the present invention associated with an upright member of a gate of a different diameter.

The gate hinge assembly 11 of the present invention is for use with a terminal gatepost 13 and a gate 15 (see, in general, FIG. 4). The gatepost 13 has a cylindrical cross sectional shape (see FIGS. 5–9). The gate 15 has an upright member 17 with a cylindrical cross sectional shape (see FIGS. 5–10). Fence material of any typical construction (e.g., wire) may be attached to the post 13 and gate 15 in any manner now apparent to those skilled in the art, such as with typical tension bands and the like (see FIG. 4). The preferred embodiment of the assembly 11 is for use with commercial gateposts 13 and gates 15 of any standard size. Thus, standard commerical gateposts 13 have nominal cross-sectional outside diameter dimensions of $2\frac{1}{2}$ inches (FIG. 5), 3 inches (FIG. 6), $3\frac{1}{2}$ inches (FIG. 7), 4 inches (FIG. 8) and $4\frac{1}{2}$ inches (FIG. 9), while standard commerical gates have upright members 17 with cross-sectional outside diameter dimensions of $1\frac{5}{8}$ inches (FIGS. 5–9) and $1\frac{7}{8}$ inches (FIG. 10). The preferred embodiment of the assembly 11 is specifically designed to be secured to any standard size gatepost 13 and to be pivotally coupled to any standard size upright member 17 relative to the gatepost 13.

The assembly 11 includes, in combination, first and second complementary clamp members 19, 21. Each clamp member 19, 21 consists in general of an elongated strap 23 having a face or inner side 25 and an outer side 27. The inner side 25 has a substantially flat first end 29, a substantially flat second end 31 and a midportion 33. The midportion 33 has a substantially V-shaped vertical groove 35 thereacross. The groove 35 is specifically designed to be centered about a post 13 of any standard diameter (see FIGS. 5–9). The first and second clamp members 19, 21 are positioned on opposite sides of the post 13 to thereby center and clamp the post 13 therebetween.

Figure 1:
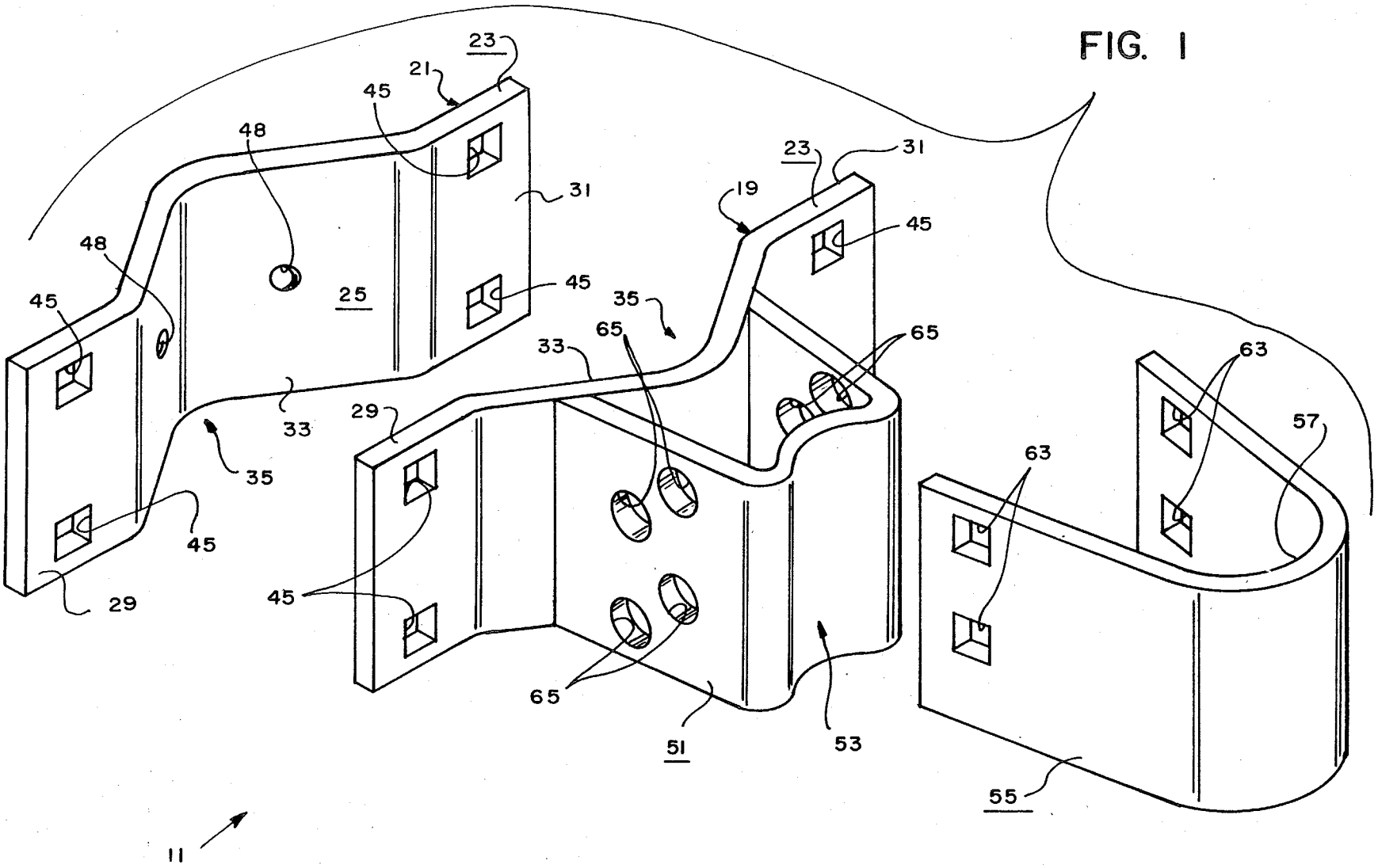
FIG. 1 is an exploded perspective view of a portion of the gate hinge assembly of the present invention.

The assembly 11 includes attachment means for securely attaching the first and second clamp members 19, 21 to one another and to the post 13. The attachment means preferably includes first bolt means for attaching the first ends 29 of the clamp members 19, 21 to one another about the post 13 and second bolt means for attaching the second ends 31 of the clamp members 19, 21 to one another about the post 13. Each bolt means preferably includes a pair of typical straight bolt members 43 for extending through a pair of attachment apertures 45 in the respective ends 29, 31 of the clamp members 19, 21, and a pair of typical nuts 46 for coacting with the bolt members 43 to secure the clamp members 19, 21 to the post 13 as will now be apparent to those skilled in the art. The apertures 45 may be substantially square in shape, as clearly shown in FIG. 1, and each bolt member 43 may have a square-shaped boss adjacent the head thereof for fitting into one of the square-shaped apertures 45 to prevent rotation of the bolts 43 as the nuts 46 are screwed thereon, etc., as will now be apparent to those skilled in the art.

The assembly 11 preferably includes lock means associated with the clamp members 19, 21 for locking the clamp members 19, 21 to the post 13. Preferably, the lock means includes first and second lock bolt members 47 and first and second threaded apertures 48 provided through the midportion 33 of the second clamp member 21 on either side of the vertical groove 35 for screwably receiving the first and second lock bolt members 47, respectively. The apertures 48 are preferably angled so as to direct the bolt members 47 against the post 13 so as to coact with the clamp members 19, 21 and attachment means to securely mount the hinge assembly 11 to the post 13 in a manner which will now be apparent to those skilled in the art.

The assembly 11 preferably includes coupling means for swingably coupling the clamp members 19, 21 to the upright member 17 of the gate 15 whereby the gate 15 will be swingably coupled to the post 13. The coupling means preferably includes a first coupling member 51 fixedly attached to the first complementary clamp member 19 as by welding or the like. The first coupling member 51 preferably has a curved apex portion 53 for engaging one side of the upright member 17 of the gate 15 (see FIGS. 5–10). The coupling means preferably includes a second coupling member 55 removably attached to the first coupling member 51 for swingably trapping the upright member 17 of the gate 15 therebetween. The second coupling member 55 preferably has a curved inner surface 57 for engaging the other side of the upright member 17 of the gate 15 (see FIGS. 5–10). The coupling means preferably includes bolt means for attaching the first and second coupling members 51, 55 to one another. The bolt means preferably includes a pair of typical straight bolt members 61 for extending through apertures 63 through the second coupling member 55 and apertures 65 through the first coupling member 51 and a pair of typical nut members 67 for coacting with the bolt members 61 to attach the coupling members 51, 55 to one another and to thereby swingably trap the upright member 17 between the first and second coupling members 51, 55 as will now be apparent to those skilled in the art. The apertures 63 may be substantially square in shape as clearly shown in FIG. 1 and each bolt member 61 may have a square-shaped boss adjacent the head thereof for fitting into one of the square-shaped apertures 63 to prevent rotation of the bolt members 61 as the nuts 67 are screwed thereon, etc., as will now be apparent to those skilled in the art. The second coupling member 55 preferably has a pair of vertically spaced and aligned apertures 63 through each side thereof (see FIG. 1). The first coupling member 51 preferably has first and second sets of paired, vertically spaced and aligned apertures 65 through each side thereof with each set of apertures 65 on each side being vertically spaced and horizontally offset from one another (see, in general, FIG. 1) to thereby allow the second coupling member 55 to be selectively turned 180 degrees relative to the first coupling member 51 for allowing either of the two standard size upright members 17 to be properly trapped by the coupling means 49 as will now be apparent to those skilled in the art.

Each gate 15 is typically mounted to a post 13 by a pair of gate hinge assemblies 11 with one hinge assembly 11 mounting the bottom of the upright member 17 to the post 13 and with another hinge assembly 11 mounting the top of the upright member 17 to the post 13 (see FIG. 4) as will now be apparent to those skilled in the art. The lower end of the post 13 is preferably embedded into concrete 69 or the like with the top of the concrete 69 or the like located at least 2 inches below the level of the ground 71 or the like adjacent the post 13 to accommodate the hinge assembly 11 (see FIG. 4) whereby the bottom of the gate 15 can be positioned adjacent and level to the surface of the ground 71 as will now be apparent to those skilled in the art.

The present invention provides means for hingeably attaching a gate to a gatepost and that is adjustable to accommodate any standard size gate and gatepost. The specific construction of the hinge assembly 11 may vary as will now be apparent to those skilled in the art. For example, the clamp members 19, 21 may be constructed out of galvanized metal in a stamping operation, etc. The various bolts and nuts are preferably off-the-shelf items. While the size of the hinge assembly 11 may vary depending on the relative size of the post 13 and gate 15, it is preferably sized for standard commercial posts and gates as hereabove discussed. The present invention meets a specific purpose of providing a hinge with only three basic separate components, eight bolts and six nuts that will fit any standard size commerical gate and gatepost as opposed to the prior art hinge assemblies which require at least two of the basic components to be replaced with different size units. This hinge does not require 5 completely different sets of clamps, etc., to properly fit all standard size commercial gates and gateposts. The present invention uses no auxiliary swivel devices, prevents any pivotal action between the hinge assembly and the gatepost, and uses no U-bolts or semi-rounded bolts.

Although the present invention has been described and illustrated with respect to a preferred embodiment and a preferred use therefor, it is not to be so limited since modifications and changes can be made therein which are within the full intended scope of the invention.

I claim:

1. A gate hinge assembly for attaching a gate to a vertical gatepost of the type being circular in cross-section, said assembly comprising:

(a) first and second complementary clamp members, each of said clamp members having an inner side with first and second ends and a midportion joining said first and second ends, said midportion of said inner side of each of said clamp members having a substantially V-shaped vertical groove therein for engaging opposite sides of said post;

(b) attachment means for attaching said first and second ends of said inner side of each of said clamp members relative to one another and for fixedly securing said clamp members to said post; and (c) coupling means attached to one of said clamp members for pivotally coupling said gate to said one of said clamp members and for thereby pivotally coupling said gate to said post, said coupling means including a first coupling member fixedly attached only to the midportion of said first clamp member and a second coupling member removably attached to said first coupling member for swingably trapping a portion of said gate thereto.

2. The assembly of claim 1 in which said V-shaped vertical groove of said inner side of said first clamp member is identical in shape and size to said V-shaped vertical groove of said inner side of said second clamp member.

3. The assembly of claim 2 in which the shape and size of said V-shaped vertical grooves of said inner sides of said first and second clamp members are designed so as to securely fit gateposts of any standard cross sectional size.

4. The assembly of claim 2 in which the geometrics of the interior angles of said V-shaped vertical grooves of said inner sides of said clamp members are designed to securely fit gateposts having nominal cross-sectional sizes of 2½ inches, 3 inches, 3½ inches, 4 inches and 4½ inches.

5. The assembly of claim 2 in which each of said ends of said inner sides of said first and second clamp members are substantially flat.

6. The assembly of claim 5 in which each end of each of said first and second clamp members has at least one attachment aperture therethrough; and in which said attachment means includes a straight bolt member for extending through one of said attachment apertures in each end of said first clamp member and through one of said attachment apertures in each end of said second clamp member, and includes a nut member for coacting with each of said bolt members to secure said clamp members to one another and to said post.

7. The assembly of claim 6 in which is included means associated with said clamp members for locking said clamp members to said post.

8. The assembly of claim 1 in which said first coupling member has a curved apex portion for engaging one side of said portion of said gate and in which said second coupling member has a curved inner surface for engaging the other side of said portion of said gate.

9. A gate hinge assembly for attaching a gate to a vertical gatepost of the type being circular in cross section, said assembly comprising:

(a) first and second complementary clamp members, each of said clamp members having an inner side with first and second ends and a midportion joining said first and second ends, said midportion of said inner side of each of said claim members having a substantially V-shaped vertical groove therein for engaging opposite sides of said post;

(b) attachment means for attaching said first and second ends of said inner side of each of said clamp members relative to one another and for fixedly securing said clamp members to said post; and (c) coupling means attached to one of said clamp members for pivotally coupling said gate to said one of said clamp members and for thereby pivotally coupling said gate to said post, said coupling means including a first coupling member fixedly attached only to said first clamp member and a second coupling member removably attached to said first coupling member for swingably trapping a portion of said gate thereto.

10. A single gate hinge assembly for hingeably attaching any gate member having a diameter within the range of $1\frac{5}{8}$ to 2 inches to any terminal gatepost having a diameter within the range of $2\frac{1}{2}$ to 5 inches, said assembly consisting of first, second and third basic component parts and attachment means for attaching said basic component parts to one another and to said any terminal gatepost having a diameter within the range of $2\frac{1}{2}$ inch to 5 inches and to said any gate member having a diameter within the range of $1\frac{5}{8}$ to 2 inches without requiring additional parts; said first basic component part including a first clamp member; said second basic component part including a second clamp member; each of said clamp members having an inner side with first and second ends and a midportion joining said first and second ends, said midportion of said inner side of each of said clamp members having a substantially V-shaped vertical groove therein for engaging opposite sides of said post, said first basic component part including a first coupling member fixedly attached only to the midportion of said first clamp member; said third basic component part including a second coupling member for coacting with said first coupling member to swingably trap said any gate member having a diameter within the range of $1\frac{5}{8}$ to 2 inches therebetween; said attachment means including bolt means for attaching said first and second ends of said inner side of each of said first and second componente parts relative to one another to fixedly secure said first and second component parts to said any terminal gatepost having a diameter within the range of $2\frac{1}{2}$ to 5 inches and including bolt means for attaching said third basic component part to said first basic component part to swingably secure said any gate member having a diameter within the range of $1\frac{5}{8}$ to 2 inches therebetween.

* * * * *